US005224535A

United States Patent [19]

Charpentier

[11] Patent Number: 5,224,535

[45] Date of Patent: Jul. 6, 1993

[54] METHOD OF AVOIDING RUN OUT ON A MACHINE FOR CASTING BETWEEN ROLLS

[75] Inventor: Jacques Charpentier, Moirans, France

[73] Assignee: Pechiney Rhenalu, Paris, France

[21] Appl. No.: 845,562

[22] Filed: Mar. 4, 1992

[30] Foreign Application Priority Data

Mar. 12, 1991 [FR] France ..... 91 03659

[51] Int. Cl.[5] ..... B22D 11/16; B22D 11/06

[52] U.S. Cl. ..... 164/480; 164/413; 164/452; 164/454

[58] Field of Search ..... 164/452, 454, 480, 154, 164/413, 428

[56] References Cited

U.S. PATENT DOCUMENTS

| | | | |
|---|---|---|---|
| 4,497,360 | 2/1985 | Bercovici | 164/413 |
| 4,678,023 | 7/1987 | Knapp et al. | 164/452 |
| 4,727,927 | 3/1988 | Popik | 164/154 |

FOREIGN PATENT DOCUMENTS

| | | | |
|---|---|---|---|
| 0056777 | 7/1982 | European Pat. Off. . | |
| 0275976 | 7/1988 | European Pat. Off. . | |
| 0655468 | 4/1979 | U.S.S.R. | 164/413 |

OTHER PUBLICATIONS

Patent Abstracts of Japan, vol. 9, No. 100 (M-376) [1923] May 1985, & JP-A-59 225 866 Shin Nippon Seitetsu K.K.-Dec. 18, 1984.

Patent Abstracts of Japan, vol. 9, No. 179 (M-399)[1902], Jul. 1985 & JP-A 360 049 835 Ishikawajima Harima Jukogyo K.K. Mar. 19, 1985.

"Light Metals", 1985, pp. 1285-1299, ISBN 0-895-20-488-6, Metallurgical Society of AIME, Warrendale, Pa., U.S., Bercovici.

*Primary Examiner*—Mark Rosenbaum
*Assistant Examiner*—Jeffrey T. Knapp
*Attorney, Agent, or Firm*—Dennison, Meserole, Pollack & Scheiner

[57] ABSTRACT

A method of avoiding run out on a machine for casting between rolls is disclosed. The method measures the value of a parameter such as the electric strength or fluid pressure supplying the motor which rotates the rolls, or the torque or force exerted by the strip on at least one of the rolls, at at least 20 equidistant positions at the periphery of at least one of the rolls and during each revolution. As soon as a reduction in the value of at least one of these parameters is observed in 3 successive positions during revolution n, relative to the value at the same positions read during revolution n−1, the rotary speed of the roll is reduced until the difference disappears, then the roll is gradually returned to the initial speed. This method enables strips of normal length to be cast without any being discarded and without any scrap being produced.

2 Claims, 3 Drawing Sheets

METHOD OF AVOIDING RUN OUT ON A MACHINE FOR CASTING BETWEEN ROLLS

FIELD OF THE INVENTION

Figure 1:
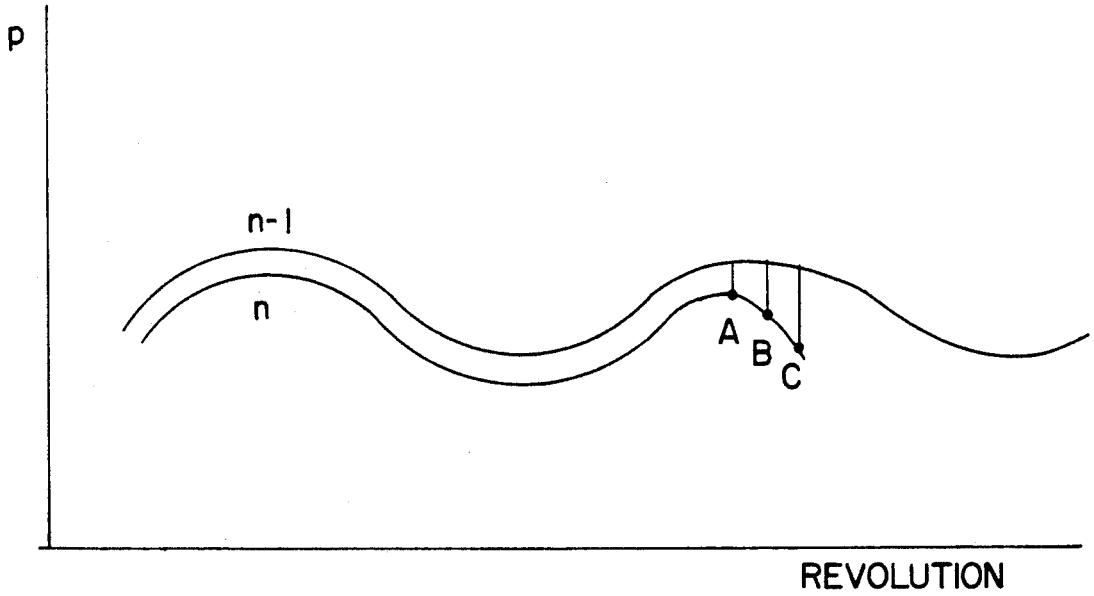

The invention relates to a method of avoiding flash (coulure) on a machine for casting between rolls.

STATE OF THE ART

Persons skilled in the art of metallurgy, chiefly of non-ferrous metals, know that metal can be put into the molten state in the form of a strip some millimeters thick, several meters wide and several tens of meters long, by means of a casting machine comprising two cooled, rotating rolls, between which the molten metal passes and is solidified and rolled in the process. A machine of this type is described particularly in French Pat. No. 1198006.

In these machines rotation may be effected either by means of a motor turning one of the rolls, while the other roll is driven by the passage of the strip or by a mechanical gearing, or by means of two motors driving each roll separately. The motors are driven at an appropriate speed either by an electric current or by a fluid in the case of a hydraulic motor.

As in all industrial activity, the purpose is to achieve maximum productivity while endeavouring to obtain a high quality product. The aim is therefore always to work at the maximum rotary speed of the rolls. However, one is restricted by heat exchange between the strip and the roll-cooling water, since application of too high a speed inevitably leads to, insufficient cooling of the strip and to the appearance of run outs. As a result the strip has to be cropped (chutage) or discarded completely, thereby lowering the production rate.

In order to avoid this disadvantage one therefore has to be able to anticipate the appearance of the run out and take the necessary measures to prepare for it.

Some solutions have indeed already been recommended to solve this problem. For example, French Pat. No. 2 498 099 describes a method of checking and regulating operating parameters of a machine for continuously casting strips between rolls, which makes it possible to avoid run outs. The method comprises measuring some parameters, such as the force exerted by the strip on at least one roll neck or the torque exerted on at least one of the rolls to advance the strip, and calculating the difference between the momentary value of the parameter and the mean value of that same parameter during an immediately preceding period. The beginnings of a flash are indicated when a change appears in that difference.

THE PROBLEM POSED

The method has been applied successfully, but it disregards some undesirable parameters, e.g. particularly the presence of out-of-round portions on the rolls, that is to say, deformations of the generatrices, which are no longer parallel with the axis of the roll.

It is known that the rolls of a casting machine generally comprise a cylindrical central core with its lateral surface covered with a jacket. After a period of time which varies according to the conditions of use, the jacket is ground to give it back the polish necessary to obtain a strip with a good surface appearance.

As a result of this grinding, which cannot be carried out perfectly, and the thermal strains to which the jacket is subjected on contact with the hot metal and the cooling liquid, every roll has an out-of-round portion.

This portion affects measurement of the above-mentioned parameters and disrupts detection of an incipient run out by the patented method.

AIM OF THE INVENTION

Applicants have sought to eliminate this disruptive factor. Their research has led them to observe, firstly, that at a constant rotary speed of the roll, the presence of an out-of-round portion is accompanied by a variation, either in the electrical strength or fluid pressure supplying the motor which drives the roll, or in the torque exerted on at least one of the rolls to advance the strip, or on the forces exerted by the strip on the rolls or on the columns of the housing frame of the machine. Secondly, they have observed that any appearance of run out was similarly preceded by a variation in said parameters, and that this was relatively great as compared with the variation due to the out-of-round portion.

SUBJECT OF THE INVENTION

The invention is therefore a method of avoiding run out on a machine for casting between rolls, comprising measuring at constant speed at least one parameter belonging to the group comprising the electrical strength or fluid pressure of the motor driving at least one of the rolls, the torque exerted on at least one of the rolls to advance the strip, and the force exerted by the strip on at least one of the rolls or on the columns of the housing frame, characterised in that at each revolution of the roll the values of at least one of said parameters are read at regular intervals in at least 20 positions of the roll, and the readings are compared for each position; when the value of said parameter $P_0$ has diminished by a quantity at least equal to 2% in three successive positions between revolution $n-1$ and revolution n, one proceeds to reduce the rotary speed of the roll until a value $P_1$ greater than $P_0$ is reached for said parameter; and as soon as the difference between the values of $P_1$ and $P_0$ remains constant for one revolution, one proceeds to increase the speed until the initial speed is reached, unless another diminution in the parameter, at least equal to 2%, appears.

Thus Applicants have developed a method of avoiding run out, based on the observations which they have made of the effect of the out-of-round portion and the signs which anticipate run out in the various parameters. The method comprises the following stages:

when the machine has started and has reached a constant speed, which may be different from the normal speed, at each roll revolution the values of at least one of the parameters $P_0$ is read at at least 20 equidistant positions on the roll, at the same place from one revolution to another the values read at one and the same place on the roll in a given revolution $n-1$ and in the next revolution are then compared.

In normal operation, that is to say, in the absence of any run out predicting sign, the values of P at an identical position are the same from one revolution to another, but this value varies between a maximum and a minimum for one and the same revolution, according to the size of the out-of-round portion. A curve representing these variations has the appearance of a sinusoid.

the probable appearance of run out is detected when the reading at three successive positions in revolution n shows a reduction in the value of $P_0$ at least equal to 2% of the value which it had at the same positions in the preceding revolution:

steps are then taken to prevent the run out from taking place: they comprise reducing the rotary speed of the roll so that the strip-cooling conditions are improved. The speed is reduced until a value $P_1$ is reached, greater than that which it had before the run out predicting sign appeared.

as soon as the values read in one revolution virtually homothetically reproduce the P curve before the action was taken, that is to say, as soon as the difference in values between the two curves is constant, one should proceed to increase the speed so that the value which it had before the deliberate reduction is obtained again. The increase preferably takes place in stages lasting no more than 5 minutes, each stage corresponding on average to an increase of a quarter of the total reduction.

In practice the P values are read by means of measuring instruments normally installed on casting machines, viz:

ammeters located in the circuits of the electric motors to measure strength;

manometers located in the fluid circuits of hydraulic motors to measure pressures;

dynamometric brakes located on the extensions of the rolls to measure the torques;

sensors located below the press cans or strain gauges located on the columns of the housing frame to measure the force exerted on the rolls by the strip.

Figure 2:
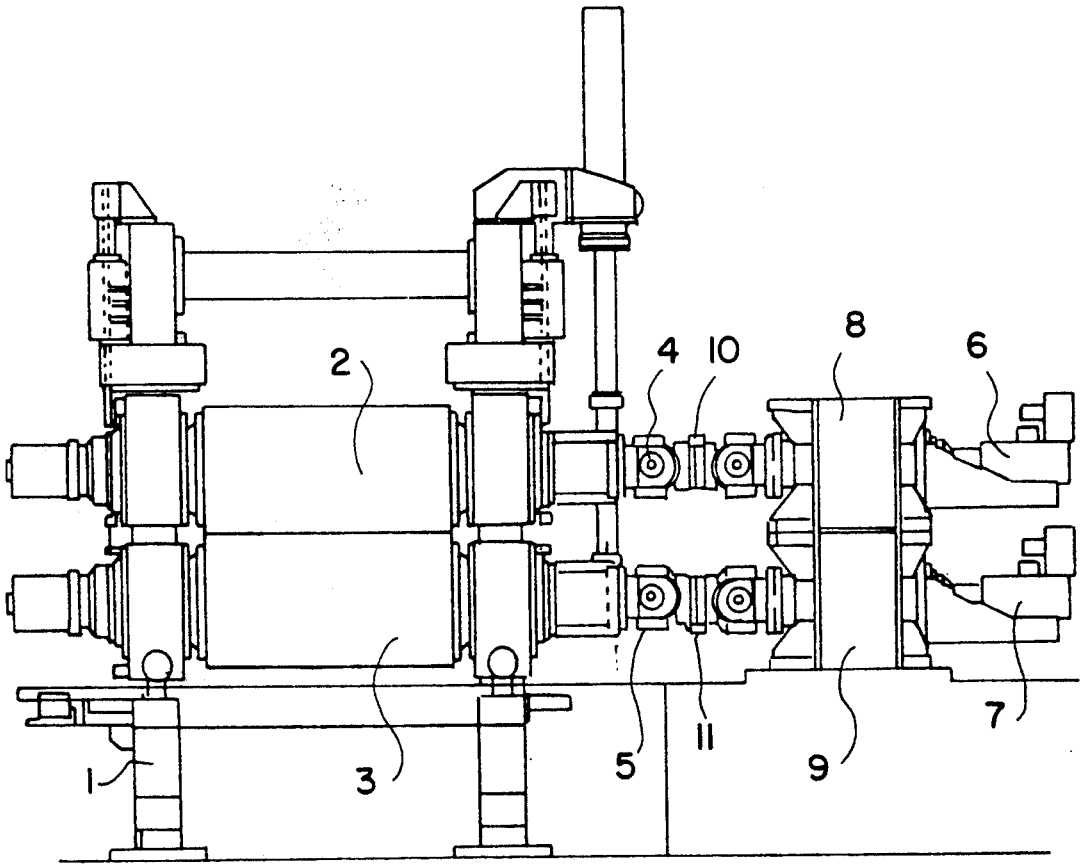
Figure 3:
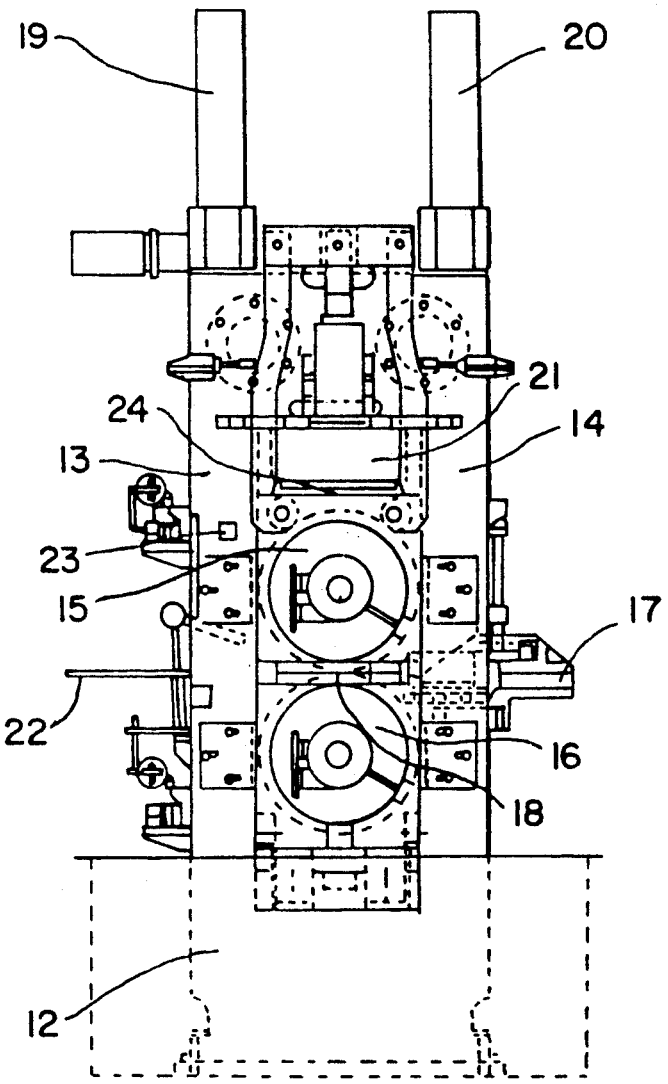

The invention will be understood better from the accompanying drawings, in which:

FIG. 1 is a sketch showing the variations of P in revolutions n−1 and n, with the appearance of the beginnings of a run out FIG. 2 is an elevation of a casting machine in a direction parallel with the axis of the rolls, and FIG. 3 is an elevation of the same machine in a direction perpendicular to said axis.

In FIG. 1 one can more particularly see two curves, giving the values of P on the ordinate and the various measuring positions in revolution n−1 and revolution n on the abscissa. The two curves have been separated for clarity, although they are merged in the absence of any incipient run out. It will be observed that the values of P diminish in three consecutive positions A, B, C, indicating the forthcoming appearance of a run out.

In FIG. 2 one can see the housing frame 1 of the machine supporting the two rolls 2 and 3, of which the extensions 4 and 5 are each connected to a motor 6 and 7 via reduction gears 8 and 9. The dynamometric brakes 10 and 11 which enable the torque to be measured are located on the extensions. Ammeters for measuring strength in the case of electric motors, and manometers in the case of hydraulic motors, may be located in the supply circuits (not shown) of the motors.

In FIG. 3 one can see the housing frame 12 and its columns 13 and 14, between which the rolls 15 and 16 are disposed. The rolls are slightly spaced from one another, so as to enable the metal in the liquid state, emanating from the feed means 17 and flowing through the nozzle 18, to solidify in contact with the rolls, to be rolled by the action of the clamping systems 19 and 20 with the aid of the ram 21, and to be converted into sheet 22. The forces are measured by means of strain gauges 23 located on the columns or sensors 24 located at the level of the rams.

The method of the invention enables strips of suitable length to be cast without any run out, and thus does not necessitate any scrap or any discarding.

I claim:

1. A method of avoiding run out on a machine supported by a housing frame for casting a strip between two rolls, at least one of which rolls is driven by an electric or hydraulic motor, comprising the steps of:

measuring at a constant initial rotary speed of at least one of the rolls a parameter P selected from the group consisting of electrical intensity for an electric motor, fluid pressure for a hydraulic motor, torque exerted on at least one of the rolls to advance the strip and force exerted by the strip on at least one of the rolls or on the housing frame;

reading initial values for $P=P_0$ at at least 20 equidistant positions of the roll during a revolution of the roll;

determining the values of P read at the same position of the roll during a given revolution n−1 and the subsequent revolution n;

reducing the rotary speed of the roll when the value of P diminishes by at least 2% compared with $P_0$ for three successive positions between revolution n−1 and revolution n;

stopping the reduction in speed when $P>P_0$ is measured;

increasing the rotary speed of the roll when the difference between P and $P_0$ remains constant between a revolution n−1 and a revolution n; and continuing said increasing until the initial rotary speed is attained, unless another diminution of P by at least 2% is measured.

2. The method of claim 1, wherein said increasing takes place in stages of a maximum duration of 5 minutes.

* * * * *